United States Patent [19]

Kårdén et al.

[11] 4,444,272

[45] Apr. 24, 1984

[54] OVERSPEED SAFETY DEVICE

[75] Inventors: Karl G. Kårdén, Östervägen; Anders H. Nilsson, Rudsjövägen, both of Sweden

[73] Assignee: Atlas Copco Aktiebolag, Nacka, Sweden

[21] Appl. No.: 434,178

[22] Filed: Oct. 14, 1982

[30] Foreign Application Priority Data

Oct. 21, 1981 [SE] Sweden ..... 8106209

[51] Int. Cl.[3] ..... B24B 23/00

[52] U.S. Cl. ..... 173/12; 51/134.5 F; 91/59; 418/41

[58] Field of Search ..... 173/12; 91/59; 415/25; 418/41, 40, 42–44; 51/134.5 R, 134.5 X; 137/50, 56, 57

[56] References Cited

U.S. PATENT DOCUMENTS

| | | | |
|---|---|---|---|
| 2,897,832 | 8/1959 | Jimerson | 173/12 |
| 3,410,030 | 11/1968 | McHenry | 173/12 |
| 3,460,437 | 8/1969 | Roggenburk | 418/41 |
| 3,749,530 | 7/1973 | A'Mador | 418/41 |
| 3,904,305 | 9/1975 | Boyd | 173/12 |
| 4,232,414 | 11/1980 | Curtiss | 51/134.5 |
| 4,278,103 | 7/1981 | Giardino | 418/41 |
| 4,346,765 | 8/1982 | Workman | 173/12 |
| 4,359,107 | 11/1982 | Smith | 173/12 |

*Primary Examiner*—James M. Meister
*Assistant Examiner*—J. L. Knoble
*Attorney, Agent, or Firm*—Frishauf, Holtz, Goodman & Woodward

[57] ABSTRACT

In a pneumatically powered rotating grinding machine there is provided a safety unit (13) comprising a speed governor and an overspeed release mechanism the purpose of which is to ensure a predetermined maximum speed. For safety reasons, the motor speed must never exceed a certain critical speed level which is determined by the mechanical strength of the working tool attached to the machine. When choosing a working tool to be attached to the machine the maximum speed mark of the machine is decisive. By having a portion of the safety unit exposed through an aperture (57) in the tool housing (10) and having the maximum speed mark (52) of the safety unit (13) located at the exposed portion, the maximum speed mark of the machine will always be the same as that of the safety unit (13). The suggested overspeed safety device avoids the risk involved in the event that a machine carrying a certain maximum speed mark might be erroneously fitted with a safety unit (13) intended for a higher maximum speed.

9 Claims, 6 Drawing Figures

OVERSPEED SAFETY DEVICE

This invention relates to an overspeed safety device for a pneumatically powered rotation tool.

BACKGROUND OF THE INVENTION

In particular, the invention concerns an overspeed safety device applied on a pneumatic rotation tool which is equipped with a speed limiting means and which carries on its housing a maximum speed mark.

The present invention is very suitable, however not exclusively intended for portable grinding machine applications where too a high motor speed is a potential danger to the operator and others at the working site. On such machines high safety demands have been put up to minimize the risk of grinding tool bursting due to overspeed.

These safety demands are well founded, because when a grinding wheel is rotated at too a high speed the inertia forces will exceed the strength of the grinding wheel material and the grinding wheel will suddenly become disintegrated into a number of fast travelling pieces. Each of those pieces posseses a high kinetic energy and is extremely dangerous to people in the vicinity of the tool, especially to the tool operator.

Usually, grinding machines are provided with speed governors for adapting the power supply to the motor in response to the load applied on the machine. The main purpose of a speed governor is to limit the speed at no-load conditions.

One way to increase safety at portable grinding machines is to employ an overspeed release mechanism for shutting off the motor in case the speed governor should become ineffective in keeping down the speed.

This is a way to prevent a malfunctioning speed governor from allowing the motor speed to reach dangerous magnitudes. As long as the speed governor operates correctly the overspeed release mechanism remains inactive, but the moment the speed governor due to hard wear, seizure or both becomes incapable of keeping down the speed the release mechanism will come into action and stop the motor.

A criterium for obtaining disintegration of a grinding wheel is the peripheral velocity of the wheel, which is dependant on the rotation speed as well as the diameter of the wheel. This means that a grinding wheel of a certain diameter is allowed to be rotated at a greater rotational speed than a grinding wheel of a bigger diameter provided the material strength is the same in the two wheels. This also means that the speed governor and the overspeed release mechanism, if fitted, have to be carefully adapted to the size of the grinding tool, or oppositely a grinding machine provided with a speed limiting means intended for a certain speed level may not be fitted with a grinding tool having a diameter exceeding a certain critical diameter. This critical diameter is determined by the maximum speed of the machine and the material strength of the tool. Accordingly, it is very important from the safety aspect that the grinding wheel and the speed limiting means of the machine are carefully adapted to each other.

Today, grinding machines of the above described type are provided with a mark plate telling about the maximum speed of the machine, and, thereby, giving indirect information of the maximum size of the tool to be safely used with the machine.

A serious problem resides in the fact that the mark plate attached to the outside surface of the machine housing or data engraved in the housing may give false information about the maximum speed of the motor.

The problem is that to many grinding machines there are available speed governors and overspeed release mechanisms covering a wide range of speed levels, These speed limiting means are intended to be fitted into machine housings of identical design but carrying different maximum speed marks. There is an obvious risk, and it has happened, that a speed control unit designed for a certain maximum speed level has been inserted in a machine housing carrying a mark on which a lower speed is readable. To such an erroneously assembled machine there may be attached an oversized grinding wheel, and there is a great risk this wheel will explode.

This means that although the machine is equipped with a perfectly operating speed governor as well as an overspeed release mechanism as an extra safety means, there might still be a risk for a tool disintegration.

SUMMARY OF THE INVENTION

The main object of the present invention is to eliminate that risk and to accomplish an increased safety against incorrect maximum speed marking of a pneumatically powered rotation tool provided with a speed limiting means.

A further object of the invention is to provide a pneumatic rotation tool with means through which the maximum speed mark readable from outside the housing is guaranteed to correspond to the maximum speed level provided by the speed limiting device actually fitted to the motor.

A further object of the invention is to accomplish an increased safety against the speed limiting means being improperly assembled, thereby ensuring the maximum speed level not exceeding the speed level readable on a maximum speed mark carried on the speed limiting means.

Still another object of the invention is to increase the safety against the motor being run without a speed limiting means being fitted at all.

Further objects and advantages of the invention will be apparent from the following description.

A preferred embodiment of the invention is hereinbelow described in detail with reference to the accompanying drawings.

DETAILED DESCRIPTION

Figure 1:
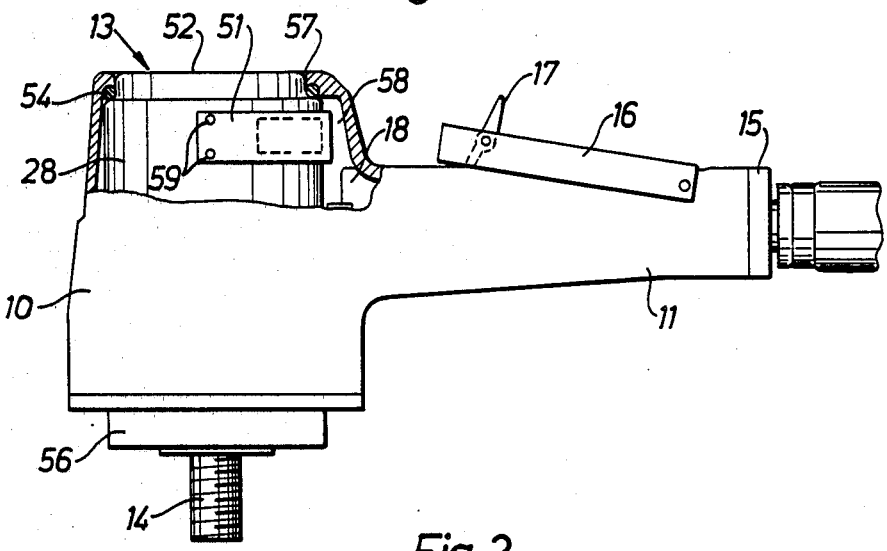
FIG. 1 shows a partly broken side view of a pneumatic portable tool on which the overspeed safety device according to the invention is applied.

In the drawing figures there is shown a portable grinding machine comprising a housing 10, a handle 11 formed integral with the housing 10, a rotation motor 12 of the sliding vane types and a safety unit 13. The motor 12 rotates an output shaft 14.

The handle 11 carries at its outer end a hose connection 15 through which motive pressure air is supplied to the machine. The air supply is manually controlled, however, via a throttle valve (not shown) which is coupled to a lever 16. A spring biased latch 17 on the lever 16 is intended to prevent unintentional starting of the motor 12. The throttle valve communicates with the motor housing 10 through an inlet passage 18.

Figure 3:
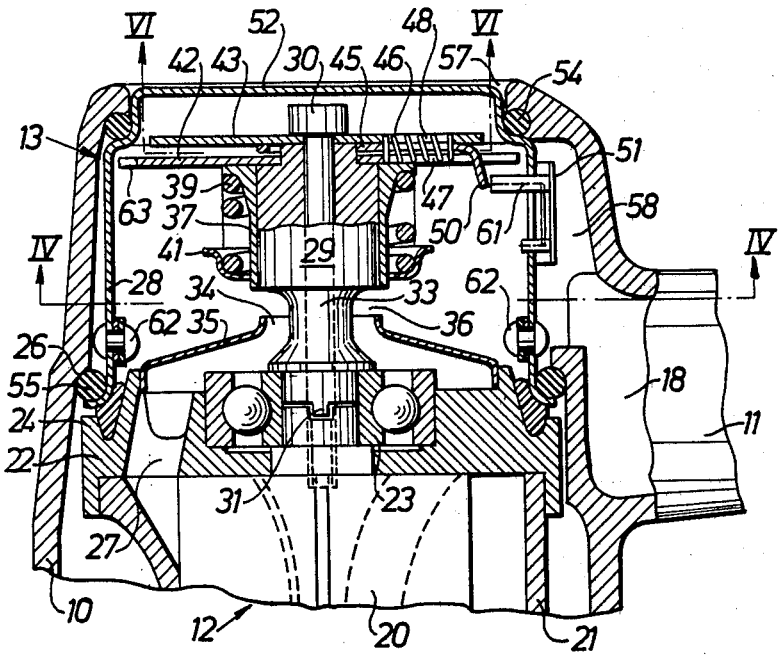
FIG. 3 shows a longitudinal section through the tool shown in FIG. 1.

The motor 12 comprises a rotor 20, a cylinder 21 and end walls. The rear end wall 22, which is shown in FIG. 3, supports a ball bearing 23 for the rotor 20. Moreover, the rear end wall 22 is formed with an outer shoulder 24 by which the motor 12 is axially supported against an internal shoulder 26 in the housing 10. The rear end wall 22 of the motor 12 is also comprises an air inlet port 27 through which motive air is fed into the cylinder 21.

The speed limiting safety unit 13 comprises a speed governor as well as an overspeed release mechanism which are both surrounded by a cup-shaped shell 28 and coupled to the rotor 20 by means of a hub 29. The latter is attached to the rotor 20 by means of a centrally located screw 30, and is positively coupled to the rotor 20 via axially directed dogs 31.

The hub 29 is formed with a waist portion 33 extending through the central aperture 34 of a cover washer 35 sealingly attached to the rear end wall 22 of the motor 12. The cover washer 35 is arranged to form with the waist portion 33 of the hub 29 an annular air passage 36 and to establish communication between that air passage 36 and the inlet port 27 of the motor 12.

The speed governor comprises a sleeve 37 axially movable on the hub 29 by means of two fly weights 38 and against the load of a spring 39. The latter acts between the governor sleeve 37 and a support member 41.

Figure 6:
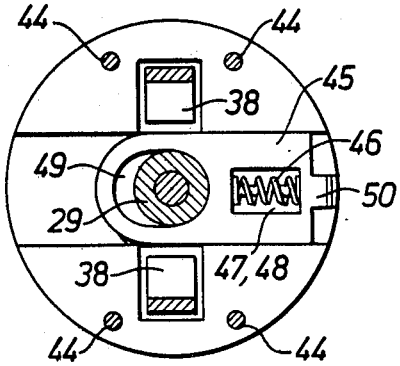
FIG. 6 is a transverse view, partly in section, taken along line VI—VI in FIG. 3.
Figure 4:
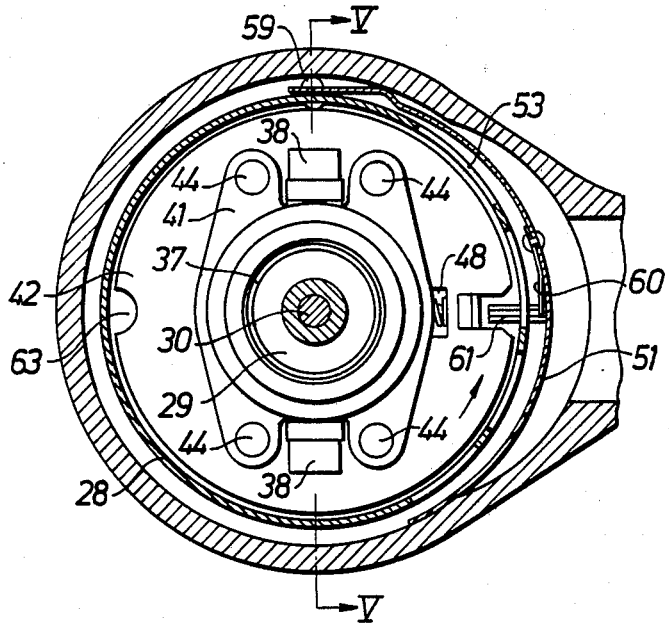
FIG. 4 is a cross section taken along line IV—IV in FIG. 3.
Figure 5:
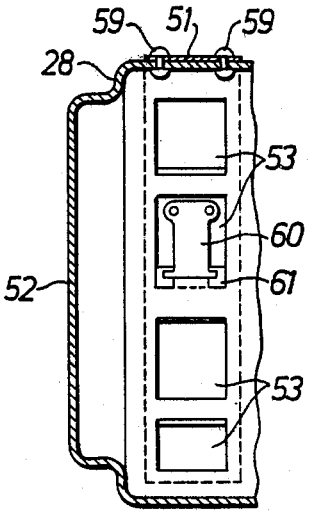
FIG. 5 is a fragmental section mainly taken along line V—V in FIG. 4.

On top of the hub 29 there are mounted two discs 42 and 43 to which the support member 41 is connected by four studs 44 (illustrated in FIGS. 4 and 6 only). The ends of the studs 44 are upset to prevent the speed governor from being too easily dismantled.

Within a predetermined speed range the governor sleeve 37 is caused to move axially by the fly weights 38, thereby adapting the width of the annular air passage 36 and the air flow to the actual operating condition of the motor 12. Between the discs 42,43 there is slidingly mounted an actuator element 45 which is one of the components forming a releasable shut-off mechanism. The actuator element 45 is radially movable by centrifugal action against the load of a spring 46 inserted in rectangular apertures 47, 48 in the discs 42,43. As illustrated in FIG. 6, the actuator element 45 has an oval opening 49 surrounding the hub 29 for permitting the actuator element 45 to be disposed radially a limited distance. At its outer end the actuator element 45 is formed with a release dog 50.

The other component of the releasable shut off mechanism is a leaf spring valve 51 mounted on the outside of the cup-shaped shell 28 and controlling a row of openings 53 in said shell 28. The shell 28 forms an insert member which is replaceably mounted in the housing 10. By means of two axially spaced O-rings 54 and 55 the shell 28 is sealingly supported in the housing 10. The shell 28 is introduced into the housing 10 from the lower end (in FIGS. 1,3) before the motor 12 and is axially clamped against the housing 10 by the motor cylinder 21. The latter is in turn axially loaded by the lower end cover 56 of the housing 10 which is threaded onto the housing 10 in a conventional manner.

As being apparent from FIGS. 1 and 3, the housing 10 is provided with an aperture 57 through which the upper end surface of the shell 28 is exposed. The upper O-ring 54 forms a seal by which pressure air is prevented from escaping out into the atmosphere, because the shell 28 and the housing 10 define between the O-rings 54 and 55 an annular chamber 58 which communicates continuously with the air inlet passage 18. Accordingly, the motor 12 can not be started unless the shell 28 is properly mounted.

The leaf spring valve 51 is attached at its one end to the shell 28 by means of two rivets 59 and is formed to fit closely to the outside of the shell 28, thereby forming a closure for the openings 53. On the leaf spring valve 51 there is mounted a spring 60 the purpose of which is to retain a trip element 61 in either of two alternative positions. In the drawing figures the trip element 61 is shown in its untripped position in which it supports the leaf spring valve 51 in open position against the elastic force developed by the leaf spring itself.

When the motor for some reason attains overspeed, the actuator element 45 is moved outwardly, whereby the release dog 50 hits the trip element 61. Thereat, the latter is tilted 90 degrees and leaves the leaf spring valve 51 free to occupy its closed position and stop the motor.

Figure 2:
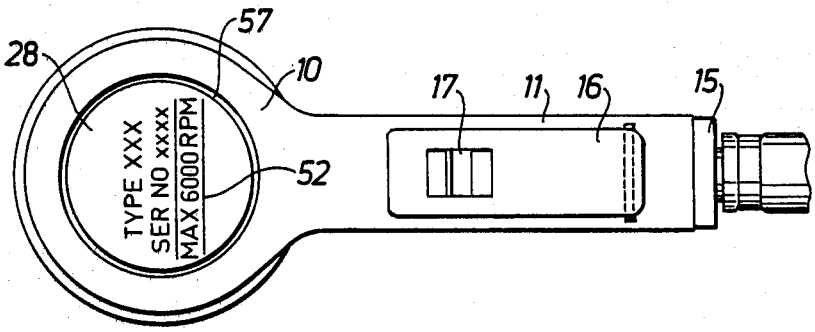
FIG. 2 is a top view of the tool shown in FIG. 1.

As illustrated in FIG. 2, the upper end surface of the shell insert 28 is provided with a maximum speed mark 52. Because of the arrangement of the end surface of the shell 28 being exposed through the aperture 57, the maximum speed mark 52 of the machine can be located to the shell 28. By this arrangement it is effectively avoided that a safety unit intended for a different maximum speed than what is marked on the housing 10 is fitted.

When the machine is one of a number of machines covering a range of different speed levels it is important to notice that all the insert shells might be identical to each other except for the maximum speed mark, whereas the actuators are designed to act at individual speed levels. It is then of great importance to ensure a correct choice of actuator in view of the maximum speed mark of the actual insert shell.

In order to avoid this risk for incorrect marking of the machine as regards the maximum speed, there are measures taken to ensure that the actuator of the overspeed release mechanism fitted to the machine is not intended for a higher speed level than what is readable on the shell 28. To that end, the insert shell 28 is provided with two diametrically opposite projections 62 the size and/or location of which is intended to match notches 63 of a corresponding size and/or location on the disc 42. If the projections 62 and the notches 63 do not match the safety unit is not possible to assemble.

A practical way of solving this matching problem would be to let the projections 62 be bigger at actuators of lower maximum speed levels. As a result, those actuators only which are intended for the very speed level readable on the shell or those intended for a lower speed level are insertable in the shell.

Since the speed governor and the overspeed release mechanism have to be carefully adapted to each other as far as the maximum speed levels are concerned, it is a good idea to let these two means form a unit which is not possible to dismantle without damaging one or more details. In the shown embodiment this is obtained by upsetting the ends of the studs 44. To dismantle the safety unit of the machine shown on the drawings the studs 44 have to be cut off or machined down at their upset ends.

The shown embodiment of the invention also offers the possibility to match the insert shell 28 to the housing 10. In a series of machines with different maximum speeds it might be necessary to make sure that the safety unit fitted to the machine does not permit too a high maximum speed. This is a seemingly superfluos precaution measure in view of the fact that the insert shell 28 itself carries the maximum speed mark 52. Still, such an arrangement might be beneficial in some cases and may easily be obtained by providing different sizes on the housing aperture 57 to match insert shells 28 of different shapes, for instance, the higher maximum speed the larger aperture.

It is emphasized that the invention is not limited to the shown and described example but may be freely varied within the frame set by the definition of the claims.

For instance, the safety device according to the invention is not just applicable on pneumatic tools provided both with a speed governor and an overspeed release mechanism, but may as well pertain to tools having a safety unit including a speed governor only.

We claim:

1. An overspeed safety device for a pneumatically powered rotation tool (12) comprising a housing (10) and being provided with a speed limiting means coupled to the motor (12), characterized in that said speed limiting means forms a safety unit (13) for replaceable mounting in the housing, said safety unit (13) being designed to act at a predetermined speed level and carrying a maximum speed mark (52), the housing (10) being formed with an aperture (57) through which said maximum speed mark (52) of the safety unit (13) is readable from outside the housing (10).

2. Safety device according to claim 1, wherein said safety unit (13) comprises a valve means (37, 51) and a speed responsive actuator (38,45) for moving or initiating movement of said valve means (37, 51) between an open position and a closed position.

3. Safety device according to claim 2, wherein said safety unit (13) comprises an insert member (28) secured in the housing (10) and carrying a maximum speed mark (52) as well as said valve means (51).

4. Safety device according to claim 3, wherein the actuator (42–50) of said safety unit (13) is designed to act at a predetermined speed level, said actuator (42–50) and said insert member (28) being individually shaped such that one particular actuator (42–50) is combinable with one particular insert member (28) only.

5. Safety device according to claim 4, wherein the shape of said insert member (28) corresponds to the different size and/or location of at least one projection (62) on said insert member (28) intended to fit with at least one notch (63) of corresponding size and/or location on the actuator (42–40).

6. Safety device according to claim 5, wherein said insert member (28) comprises a tubular portion into which said actuator (42–50) is to be received, said at least one projection (62) being disposed on the inner peripheral wall of said tubular portion.

7. Safety device according to any one of claims 1–6, wherein the housing (10) and said safety unit (13) are provided with co-operating seal means (54) by which motive pressure air is prevented from escaping into the atmosphere via said aperture (57) only when the safety unit (13) is properly mounted in the housing (10).

8. Safety device according to anyone of claims 3–6, wherein said valve means (37, 51) comprises at least one air supply opening (53) through said insert member (28) and a valve element (51) supported on said insert member (28) and arranged to obstruct the air flow through said openings (53) when moved or initiated to be moved by said actuator (42–50).

9. Safety device according to claim 8, wherein said valve means (51) and said actuator (42–50) together form a releasable shut off mechanism.

* * * * *